US009751206B1

(12) United States Patent
Nelson et al.

(10) Patent No.: US 9,751,206 B1
(45) Date of Patent: Sep. 5, 2017

(54) RIGHT ANGLE STEEL WORKER'S LAYOUT TOOL

(71) Applicants: Douglas Nelson, Layton, UT (US); Juan Morales, Layton, UT (US)

(72) Inventors: Douglas Nelson, Layton, UT (US); Juan Morales, Layton, UT (US)

( * ) Notice: Subject to any disclaimer, the term of this patent is extended or adjusted under 35 U.S.C. 154(b) by 99 days.

(21) Appl. No.: 14/877,023

(22) Filed: Oct. 7, 2015

(51) Int. Cl.
*B25H 7/00* (2006.01)
*B25H 7/04* (2006.01)

(52) U.S. Cl.
CPC ..... *B25H 7/04* (2013.01)

(58) Field of Classification Search
CPC ... B25H 7/00; B25H 7/02; B25H 7/04; B25H 1/0092
USPC ..... 33/669, 418, 452
See application file for complete search history.

(56) References Cited

U.S. PATENT DOCUMENTS 1,745,471 A 2/1930 Bickel
2,893,133 A 7/1959 Sacher
3,731,390 A 5/1973 Peters
4,228,594 A 10/1980 Shlager
4,233,747 A 11/1980 Fisher
4,270,276 A 6/1981 Skura
4,955,141 A * 9/1990 Welch ..... G01B 3/56 33/418
5,123,172 A * 6/1992 Thrun ..... E04F 21/00 269/905
5,367,783 A * 11/1994 Nygren ..... E04G 21/1891 33/478
5,682,934 A 11/1997 Rybski
6,272,758 B1 * 8/2001 Wheeler ..... B43L 7/027 33/1 G
6,510,616 B1 * 1/2003 Sparkman ..... E04F 21/26 33/456
8,375,592 B1 * 2/2013 Holt ..... B43L 7/12 33/456
8,661,699 B2 * 3/2014 Vadala ..... B43L 7/027 33/32.2
8,720,073 B1 * 5/2014 Gordon ..... E04F 21/0015 33/194
9,435,130 B2 * 9/2016 Briganti ..... B25H 7/04
2009/0013546 A1 * 1/2009 Keller ..... B43L 7/027 33/451
2011/0107610 A1 * 5/2011 Farr ..... B43L 7/12 33/421
2015/0191039 A1 * 7/2015 Johnson ..... B43L 7/14 33/427
2015/0276367 A1 * 10/2015 Lamanna ..... G01B 3/566 33/404

FOREIGN PATENT DOCUMENTS

WO WO2010065114 9/2010

* cited by examiner

*Primary Examiner* — Yaritza Guadalupe-McCall

(57) ABSTRACT

The right angle steel worker's layout tool is a tool with a pair of adjustable marking slides that are each used for determining the location of welds and holes on steel beams. Each of the pair of adjustable marking slides is comprised of a lower lock plate, an upper lock plate, a lock knob, and a screw member. The lower lock plate is able to slide along a track groove provided on the tool. The lock knob is used to secure the upper lock plate and the lower lock plate at a designated location along the track groove. The track groove includes a plurality of markings used to designate different dimensions.

8 Claims, 4 Drawing Sheets

RIGHT ANGLE STEEL WORKER'S LAYOUT TOOL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of tools for metal working, more specifically, a layout tool for use with steel objects.

SUMMARY OF INVENTION

The right angle steel worker's layout tool is a tool with a pair of adjustable marking slides that are each used for determining the location of welds and holes on steel beams. Each of the pair of adjustable marking slides is comprised of a lower lock plate, an upper lock plate, a lock knob, and a screw member. The lower lock plate is able to slide along a track groove provided on the tool. The lock knob is used to secure the upper lock plate and the lower lock plate at a designated location along the track groove. The track groove includes a plurality of markings used to designate different dimensions.

These together with additional objects, features and advantages of the right angle steel worker's layout tool will be readily apparent to those of ordinary skill in the art upon reading the following detailed description of the presently preferred, but nonetheless illustrative, embodiments when taken in conjunction with the accompanying drawings.

In this respect, before explaining the current embodiments of the right angle steel worker's layout tool in detail, it is to be understood that the right angle steel worker's layout tool is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the right angle steel worker's layout tool.

It is therefore important that the claims be regarded as including such equivalent construction insofar as they do not depart from the spirit and scope of the right angle steel worker's layout tool. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
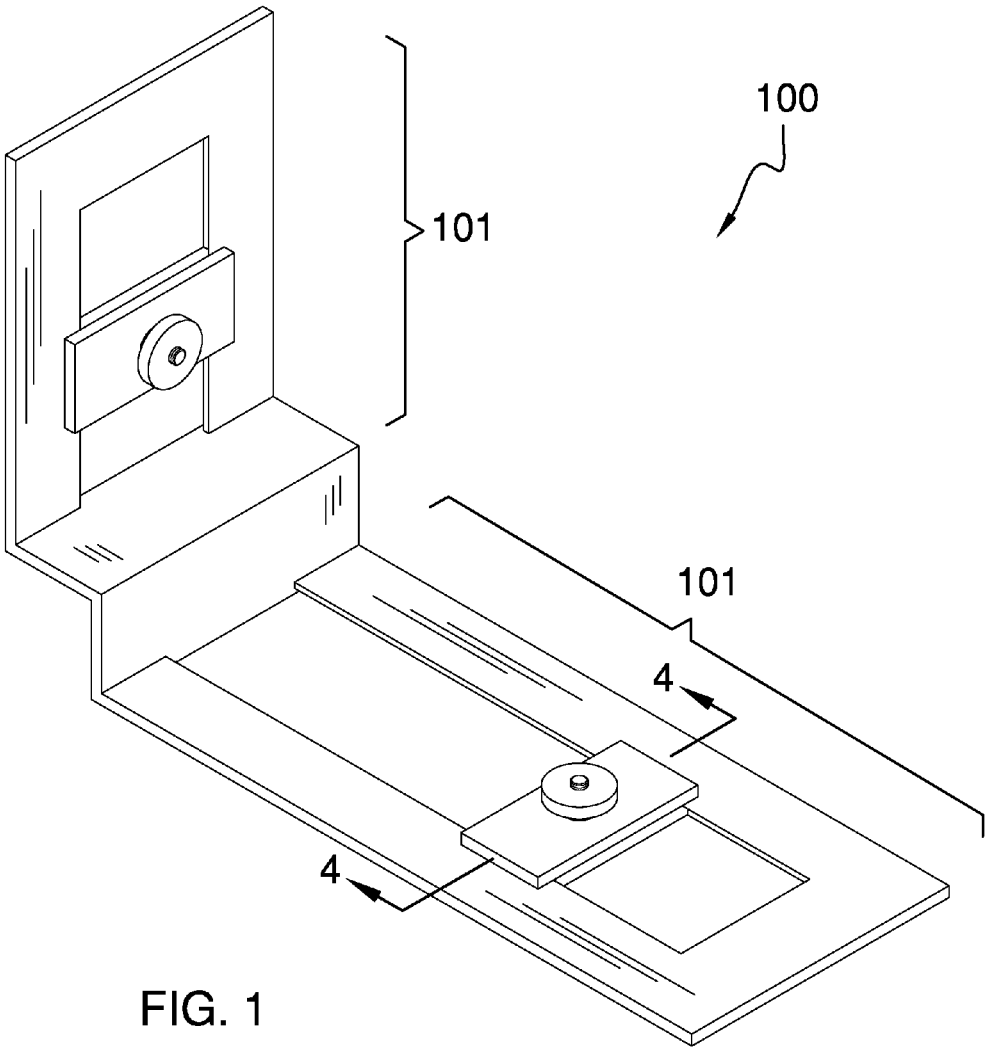
FIG. 1 is a perspective view of an embodiment of the disclosure.
Figure 2:
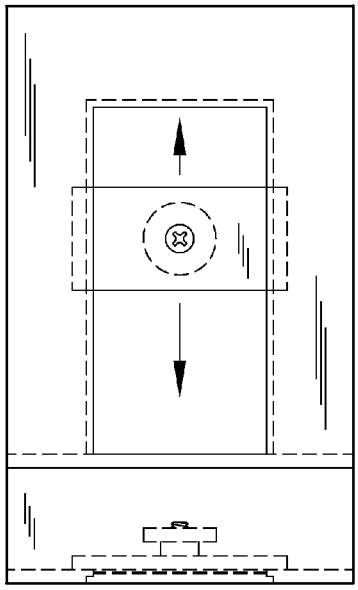
FIG. 2 is a left end view of an embodiment of the disclosure.
Figure 3:
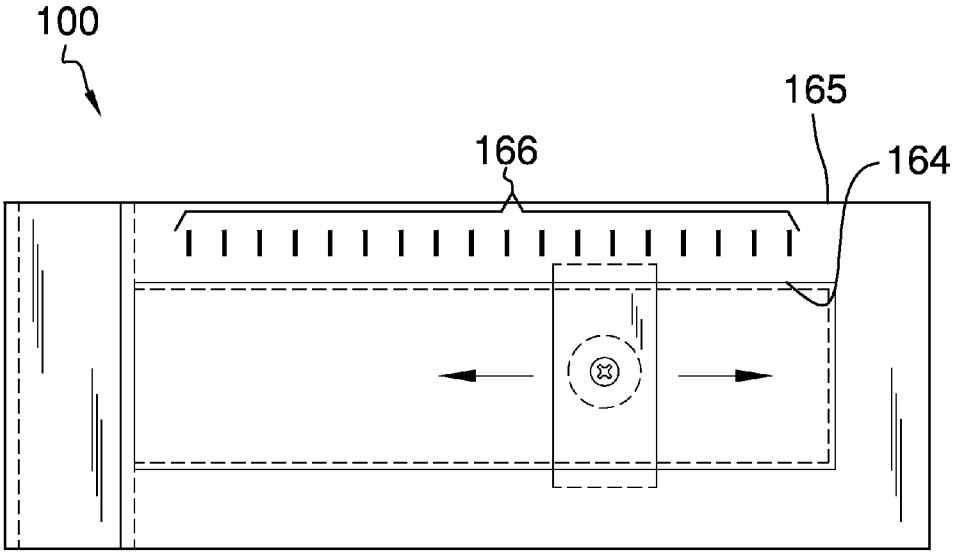
FIG. 3 is a bottom view of an embodiment of the disclosure.
Figure 4:
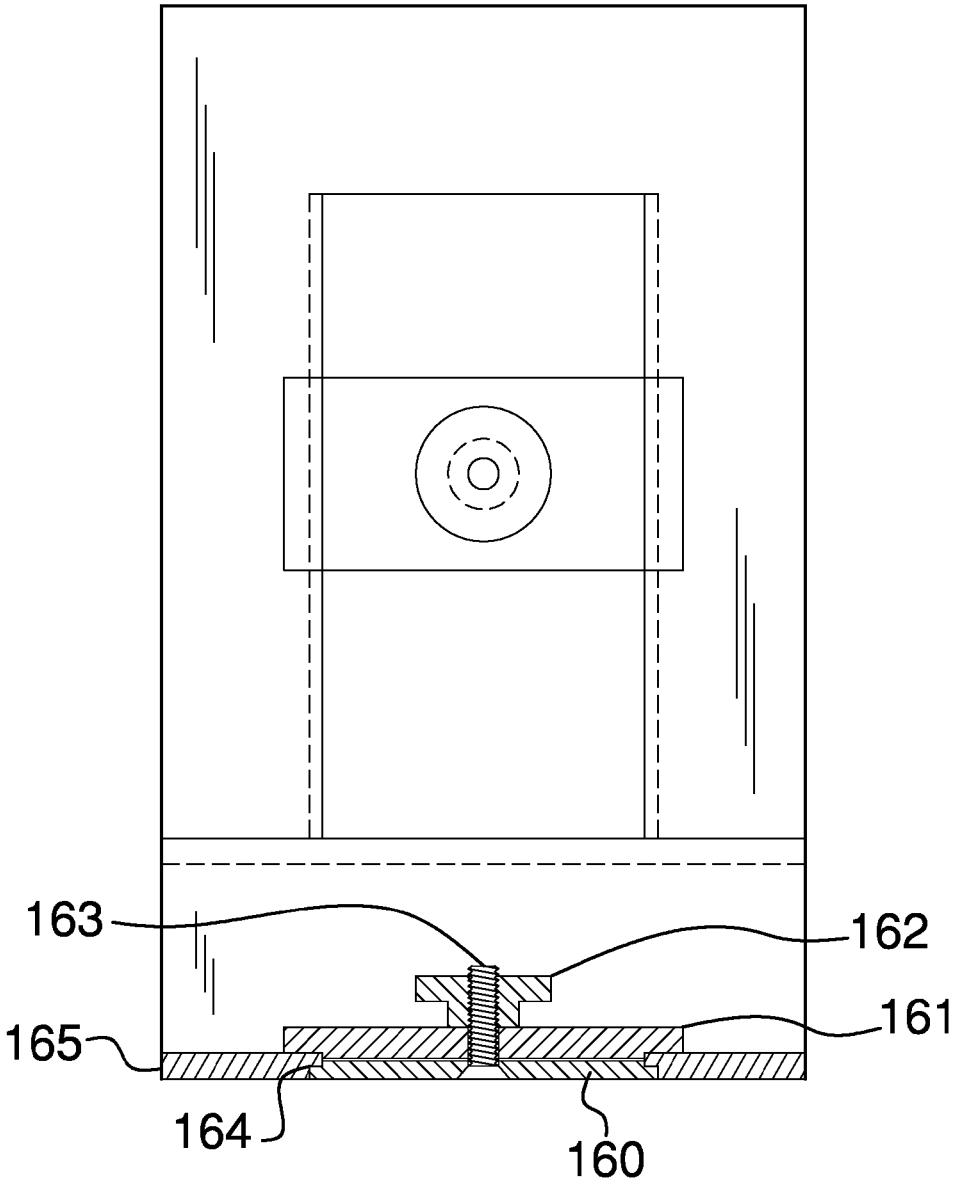
FIG. 4 is a cross-sectional view of an embodiment of the disclosure along line 4-4 in FIG. 1.
Figure 5:
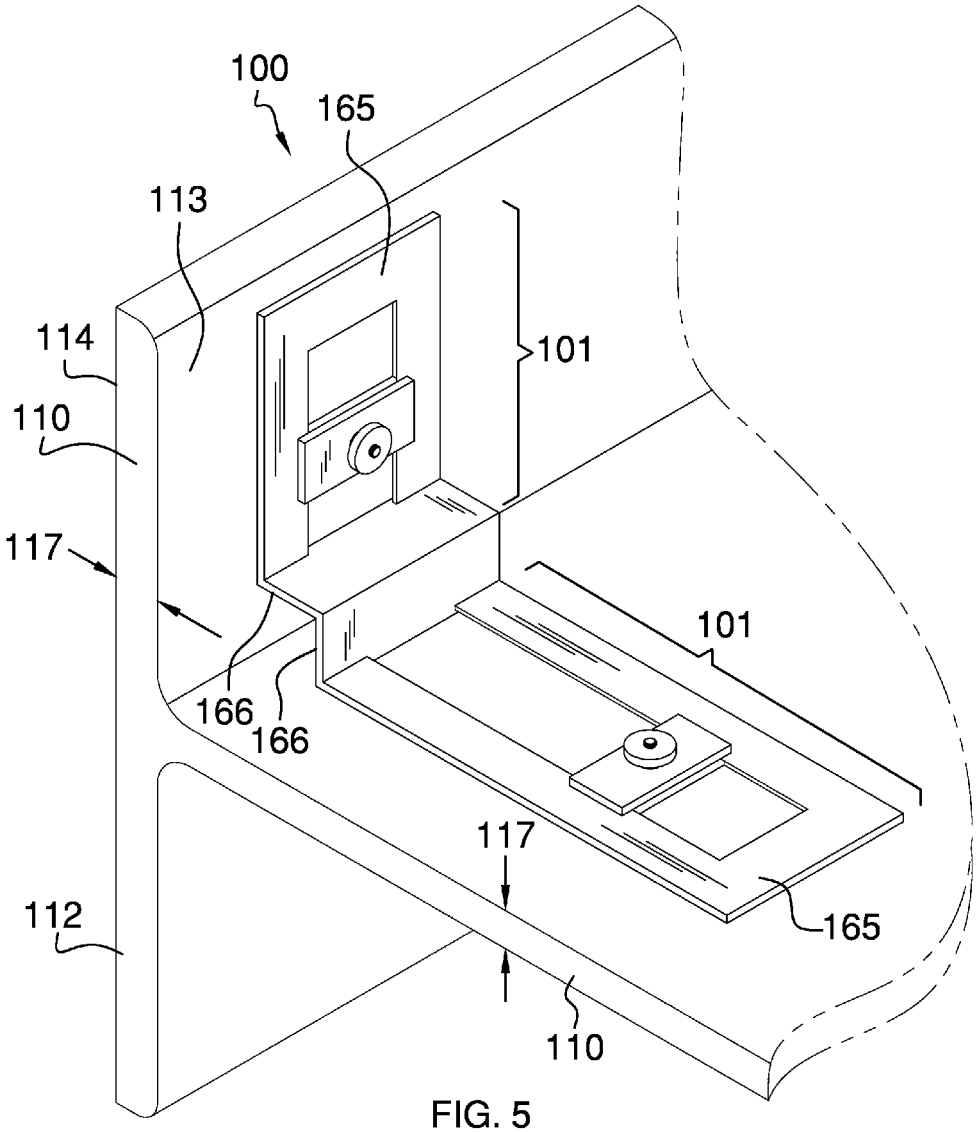
FIG. 5 is a perspective view of an embodiment of the disclosure in use.

Detailed reference will now be made to a first potential embodiment of the disclosure, which is illustrated in FIGS. 1 through 5. The right angle steel worker's layout tool 100 (hereinafter invention) comprises a plurality of measuring devices 101.

The purpose of each of the plurality of measuring devices 101 is to position the lay out markings required for fabrication. Items being laid out include, but are not limited to, weld locations or hole locations. Each of the each of the plurality of measuring devices 101 is adapted for use with a structural object 110. A structural object 110 is further defined as comprising two metal plates, metal beams, or metal flanges that are set at right angles to each other. The metal plate, metal beam, or metal flange being measured is referred to as the beam 111 in this disclosure. The metal plate, metal beam, or metal flange that is not being measured is referred to as the frame 112 in this disclosure.

In the first potential embodiment of the disclosure, each of the plurality of measuring devices 101 is adapted to be used with a first frame of a first predetermined thickness 117 and a second frame of a second predetermined thickness 117. Each of the plurality of measuring devices 101 is adapted to measure the distance from the rear surface 114 of the frame 112. In the first potential embodiment of the disclosure, each of the plurality of measuring devices 101 is calibrated to measure distance in either Metric Units or United States Customary Units.

In a second potential embodiment of the disclosure, each of the plurality of measuring devices 101 is adapted to be used with a frame of a predetermined thickness 117. With one exception, the plurality of measuring devices 101 is adapted to measure the distance from the rear surface 114 of the frame 112. In the second potential embodiment, each of the plurality of measuring devices 101 is calibrated to measure distance in both Metric Units and United States Customary Units.

Each of the pair of adjustable marking slides 101 is comprised of a lower lock plate 160, an upper lock plate 161, a lock knob 162, and a screw member 163. The lower lock plate 160 is able to slide along a track groove 164 provided on a plate 165. The lock knob 162 is used to secure the upper lock plate 161 and the lower lock plate 160 at a designated location along the track groove 164. The track groove 164 includes a plurality of markings 166 used to designate different dimensions.

Each of the pair of adjustable marking slides 101 includes a right member 166. The right members 166 of each of the pair of adjustable marking slides 101 are at a right angle with respect to one another. The right members 166 are affixed to one another. The right members 166 are positioned between the plates 165 of the pair of adjustable marking slides 101.

Each of the plurality of measuring devices is made of metal. Suitable metals include, but are not limited to, steel and aluminum. Each of the plurality of measuring devices can be formed from a mold or assembled from a plurality of metal plates. If the optional markings are provided, the marking can be engraved or included as part of the mold.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

Is shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A layout tool comprising:

a plurality of measuring devices;

wherein the layout tool is adapted for use with structural objects;

wherein the layout tool measures distances;

wherein the structural object is further defined with a beam and a frame;

wherein the frame is further defined with a front surface and a rear surface;

wherein the layout tool is adapted to measure the distance from frame of the structural object to a location on the beam of the structural object;

wherein one of the plurality of measuring devices is a primary measuring device;

wherein the plurality of measuring devices is further defined as being a primary measuring device and a plurality of remaining measuring devices;

wherein the plurality of measuring devices is adapted to be used with a first frame of a first predetermined thickness and a second frame of a second predetermined thickness;

wherein each of the plurality of measuring devices is adapted to measure the distance from the rear surface of the frame;

wherein the plurality of measuring devices is further defined as a pair of adjustable marking slides;

wherein each of the pair of adjustable marking slides is comprised of a lower lock plate, an upper lock plate, a lock knob, and a screw member;

wherein the lower lock plate is able to slide along a track groove provided on a plate;

wherein the lock knob is used to secure the upper lock plate and the lower lock plate at a designated location along the track groove;

wherein the track groove includes a plurality of markings used to designate different dimensions;

wherein each of the pair of adjustable marking slides includes a right member.

2. The layout tool according to claim 1 wherein the right members of each of the pair of adjustable marking slides are at a right angle with respect to one another.

3. The layout tool according to claim 2 wherein the right members are affixed to one another.

4. The layout tool according to claim 3 wherein the right members are positioned between the plates of the pair of adjustable marking slides.

5. A layout tool comprising:

a plurality of measuring devices;

wherein the layout tool is adapted for use with structural objects;

wherein the layout tool measures distances;

wherein the structural object is further defined with a beam and a frame;

wherein the frame is further defined with a front surface and a rear surface;

wherein the layout tool is adapted to measure the distance from frame of the structural object to a location on the beam of the structural object;

wherein one of the plurality of measuring devices is a primary measuring device;

wherein the plurality of measuring devices is further defined as being a primary measuring device and a plurality of remaining measuring devices;

wherein the plurality of measuring devices is adapted to be used with a first frame of a first predetermined thickness and a second frame of a second predetermined thickness;

wherein each of the plurality of measuring devices is adapted to measure the distance from the rear surface of the frame;

wherein the plurality of measuring devices is further defined as a pair of adjustable marking slides;

wherein each of the pair of adjustable marking slides is comprised of a lower lock plate, an upper lock plate, a lock knob, and a screw member;

wherein the lower lock plate is able to slide along a track groove provided on a plate;

wherein the lock knob is used to secure the upper lock plate and the lower lock plate at a designated location along the track groove;

wherein the track groove includes a plurality of markings used to designate different dimensions;

wherein each of the pair of adjustable marking slides includes a right member.

6. The layout tool according to claim 5 wherein the right members of each of the pair of adjustable marking slides are at a right angle with respect to one another.

7. The layout tool according to claim 6 wherein the right members are affixed to one another.

8. The layout tool according to claim 7 wherein the right members are positioned between the plates of the pair of adjustable marking slides.

* * * * *